United States Patent [19]

Quante

[11] 4,123,970

[45] Nov. 7, 1978

[54] APPARATUS FOR FILLING CONTAINERS WITH COMPACTED REFUSE

[75] Inventor: Siegfried Quante, Düsseldorf, Germany

[73] Assignee: Lindemann Maschinenfabrik GmbH, Düsseldorf, Germany

[21] Appl. No.: 793,311

[22] Filed: May 3, 1977

[30] Foreign Application Priority Data

May 13, 1976 [DE] Fed. Rep. of Germany ..... 2621158

[51] Int. Cl.[2] ..... B30B 15/30

[52] U.S. Cl. ..... 100/45; 100/99; 100/215; 100/218; 100/223; 100/229 A; 214/2; 214/41 A; 177/25; 177/123; 53/502

[58] Field of Search ..... 100/45, 99, 215, 218, 100/223; 214/2, 41 A; 177/25, 123; 53/124 TS, 59 W

[56] References Cited

U.S. PATENT DOCUMENTS

| | | | |
|---|---|---|---|
| 3,561,624 | 2/1971 | Thurmond | 214/41 A |
| 3,640,411 | 2/1972 | Anderson | 214/41 A |
| 3,753,506 | 8/1973 | Palmer | 100/229 A X |
| 3,939,928 | 2/1976 | Murakami | 177/25 |
| 3,945,448 | 3/1976 | Sellers | 177/25 |
| 3,962,965 | 6/1976 | Corompt | 100/99 |
| 3,992,905 | 11/1976 | Oberley | 100/215 X |
| 4,040,230 | 8/1977 | Stodt | 53/59 W |

*Primary Examiner*—Billy J. Wilhite

*Attorney, Agent, or Firm*—Toren, McGeady and Stanger

[57] ABSTRACT

Apparatus for filling containers with refuse which has been compacted by pressing comprises a weighing device for weighing refuse collecting vehicles, a plurality of holders each capable of holding and discharging a batch of refuse from one vehicle, a refuse press including a filling shaft and two conveyor belts, which are preferably arranged one on each of two opposite sides of the filling shaft, for conveying batches of refuse discharged from the holders, which are arranged in a row, to the filling shaft of the press. The apparatus enables batches of refuse of different weights from each other to be selected from a larger number of batches to provide optimum filling of the container with the weight of the contents of the container closely approximating a predetermined weight.

6 Claims, 4 Drawing Figures

APPARATUS FOR FILLING CONTAINERS WITH COMPACTED REFUSE

This invention relates to apparatus for filling containers with refuse which has been compacted by pressing. The apparatus includes a refuse press, comprising a filler box, a pressing plunger which is movable horizontally through the filler box, a filler shaft which leads into the filler box in a direction transverse to the movement of the plunger and a pressing box aligned with the filler box, the plunger being arranged to push refuse, which is introduced through the filling shaft into the filler box, into the pressing box and compress it against a wall of the pressing box.

Especially in densely populated regions, the disposal of refuse leads to problems which become continually more difficult to solve, since the procuring of suitable plots of ground for tipping the refuse is either very difficult or indeed impossible, and it is in these very highly populated regions that the tipping of refuse leads to detrimental environmental effects.

At the present time, these problems are counteracted by communities setting up refuse tipping points far from residential areas and transporting the refuse to these points. Since the transportation of refuse over long distances by means of conventional refuse-collecting trucks is very uneconomical, it is necessary to compact the refuse at central collecting points and to transfer it into container vehicles, which are capable of receiving the contents of several conventional refuse trucks, so that the transportation over fairly large distances becomes more economical.

A considerable disadvantage of this method of operation lies in the fact that the container vehicles become overloaded if the refuse is too highly compacted or its initial density is relatively high. The vehicles do not then comply with axle loading regulations, quite apart from the fact that their road safety can no longer be guaranteed. Precautions taken to observe these regulations and safety considerations, however, very easily result in the permissible loading of the container vehicles being not fully utilised. This is extremely undesirable from an economic standpoint.

The aim of the present invention is to provide apparatus for filling a container with refuse which has been compacted by pressing, the apparatus making possible reliably and rapidly and in a simple manner the maximum practicable utilisation of the permissible container loading.

To this end, according to this invention, such apparatus comprises a weighting device for weighing refuse collecting vehicles, a number of holders each capable of holding and discharging a batch of refuse from one vehicle, a refuse press comprising a filler box, a pressing plunger which is movable horizontally through the filler box, a filling shaft which leads into the filler box in a direction transverse to the movement of the plunger and a pressing box aligned with the filler box, the plunger being arranged to push refuse, which is introduced through the filling shaft into the filler box, into the pressing box and compress it against a wall of the pressing box, and at least one conveyor for conveying batches of refuse discharged from the holders to the filling shaft of the press.

The use of this apparatus gives rise to a method of filling containers wherein a number of batches of refuse each consisting of the contents of a filled refuse collecting vehicle are individually weighed, a smaller number of these weighed batches are selected such that the sum of the individual weights of the selected batches approximates as closely as possible, according to the weights of the batches available, to a predetermined desired weight of the contents of the container, and the selected batches are pressed and after pressing are pushed into the container.

Not only is this method rapid but it also prevents the maximum permissible filled weights of the containers from being exceeded. As a result of the fact that continuous metering of the contents of the containers during the filling operation is dispensed with in favour of a short transhipment time of the refuse from the collection vehicles in an intermediate storage bunker, it may sometimes occur that the containers are not quite filled to their full predetermined weights, but against this there is the considerable advantage, associated with the omission of bunkering, that a whole number multiple of refuse truck loads is always combined to provide one container filling.

The utilisation of the predetermined permissible container loading can be further optimised with a preferred method in which the selected batches of refuse are individually compressed and as each batch is compressed a new weighed batch is made available in its place, a check is then made of the weight of the new batch and a new selection including the new batch is made if the total weight of this new selection is closer to the predetermined weight than was the total weight of the previous selection.

This method takes account, in an especially effective manner, of the circumstance that the individual refuse collection vehicle loads differ in their composition and thus in their specific weight, not least on account of their varying origins, so that the statistical random distributions can be continually made use of for determination and establishment of the remaining capacity of a container being filled by the addition of further individual batches.

With the apparatus in accordance with the invention, after appropriate selection of the contents of the holders for filling one container, one of the selected holders can first discharge its contents on to the conveyor, so that during the feeding of the press with this batch, the holder which has just been emptied can be refilled and, in accordance with a preferred operating procedure, the new batch with which it has been filled can be incorporated into a renewed checking to provide a new selection of batches to give an optimum residual filling for the container.

In order that, at any time during the filling of a container, a sufficiently large number of filled holders, which may be in the form of tilting troughs, shall always be available for combining into an optimum container load, the number of tilting troughs is preferably greater than the number of batches of refuse necessary to fill one of the containers.

Preferably, the number of tilting troughs is at least twice the number of batches of refuse necessary to fill one of the containers. Then, not only is the statistical loading distribution into the individual tilting troughs utilised in an excellent manner for the purposes of selection of the individual batches to form one container filling, but the facility is also provided for assembling the contents of the next container by the selection of suitable batches in the tilting troughs as soon as the last batch for the previous container has been discharged on to the conveyor.

The selection and assembly of the batches to give an optimum container filling can be considerably simplified and expedited by associating with each holder a weight indicator, and by having all the weight indicators connected to a computer which selects from the holders the batches, the sum of the weights of which approximates to the predetermined weight, and which causes the holders of the selected batches to discharge their contents to the conveyor, or conveyors. With this arrangement, the net weight of refuse is fed into the weight indicator as each vehicle is discharged into the holder, for example, by means of a weight card issued by the weighing device, and the weight is fed to the computer for selection, together with an identifying signal associated with the holder.

A considerable increase in the rate of container filling can be achieved if, as is preferred, the press is in the form of a horizontal revolving box press including two pressing boxes pivoted about an axis parallel to the direction of movement of the pressing plunger to move between a pressing position in alignment with the pressing plunger between the filler box and a counter-abutment and an ejecting position in alignment between an ejector plunger and a station for a container to be filled.

With this press, the pressing of the refuse for filling one container can be carried out independently of the pushing of the previously pressed refuse into a preceding container and independently of the movement times of the containers, so that during the pushing-in of pressed refuse into one container the pressing of the refuse intended for the next container can be started.

An especially space-saving arrangement of the apparatus is achieved if the conveyor comprises two conveyor belts extending along a row of the holders in a direction perpendicular to the direction of movement of the pressing plunger, the belts being disposed one on each of two opposite sides of the filling shaft.

The various features of novelty which characterize the invention are pointed out with particularity in the claims annexed to and forming a part of this disclosure.

For a better understanding of the invention, its operating advantages and specific objects attained by its use, reference should be had to the accompanying drawings and descriptive matter in which there is illustrated and described a preferred embodiment of the invention.

Figure 1:
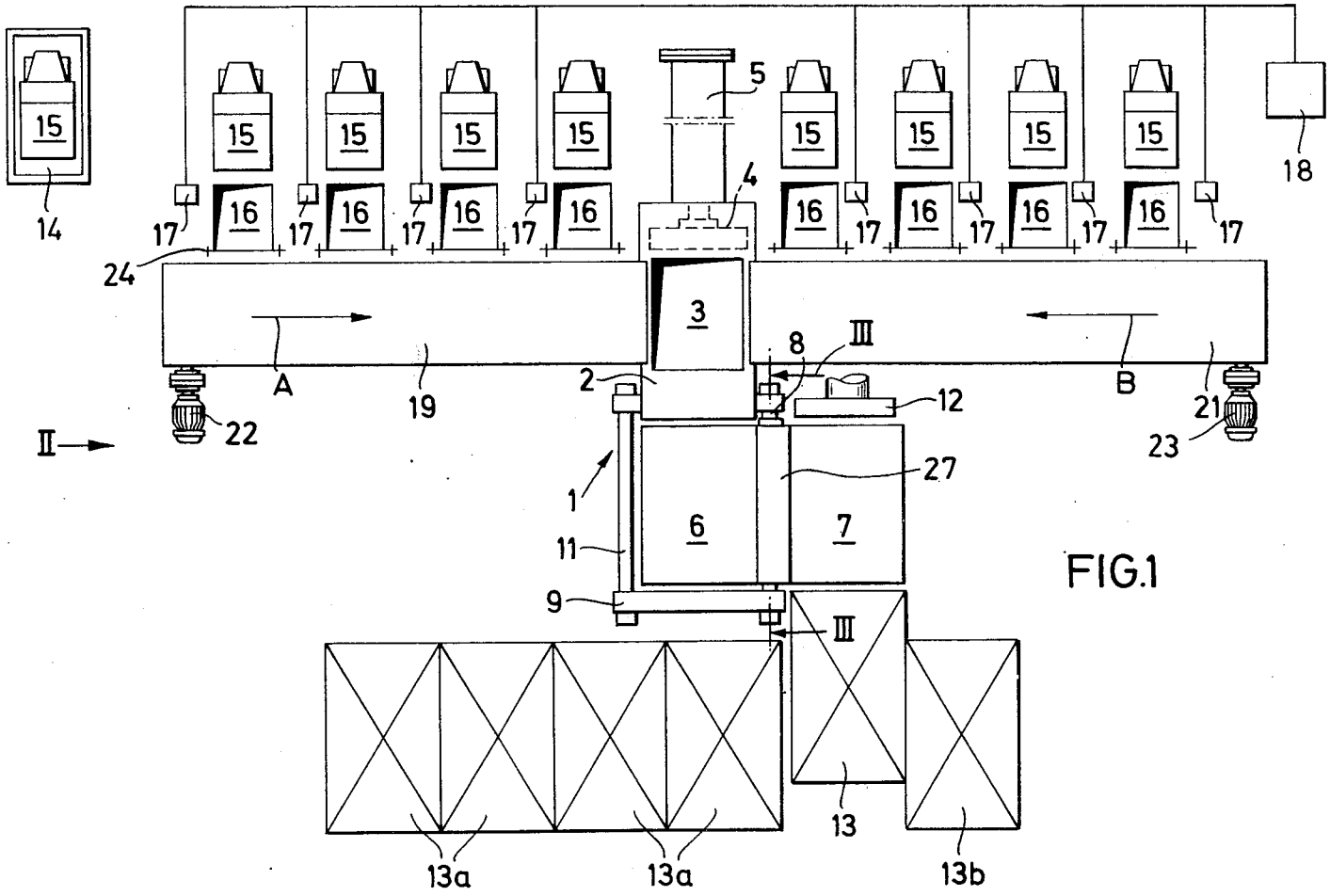
FIG. 1 is a diagrammatic plan view of the apparatus embodying the present invention.

The apparatus includes, near its middle, a refuse press 1, which comprises a horizontal filler box 2 with a filler shaft 3 entering it vertically from above and a pressing plunger 4 which moves horizontally and is disposed coaxially in the filler box 2. The plunger 4 is operated by means of a hydraulic ram 5.

Figure 2:
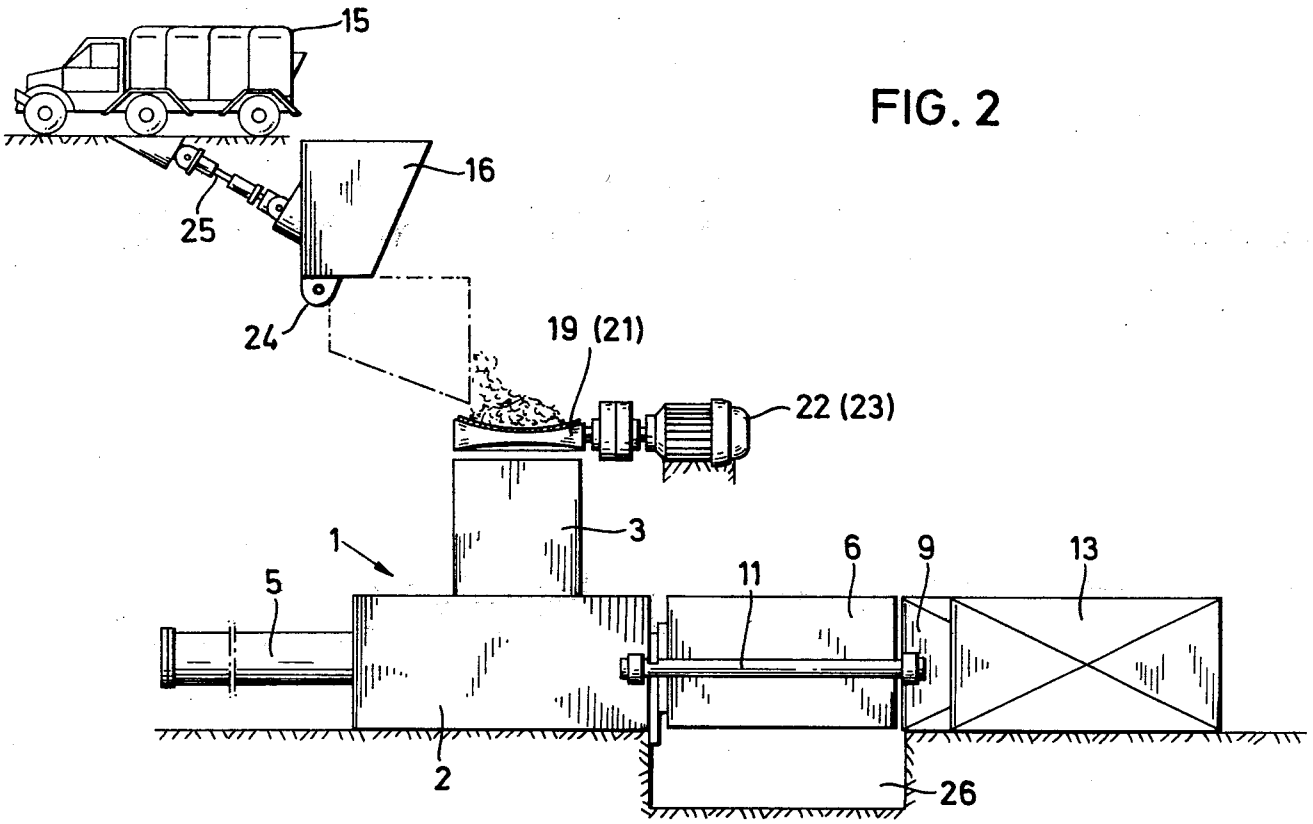
FIG. 2 is a side view of the apparatus illustrated in FIG. 1 taken in the direction of the arrow II.
Figure 3:
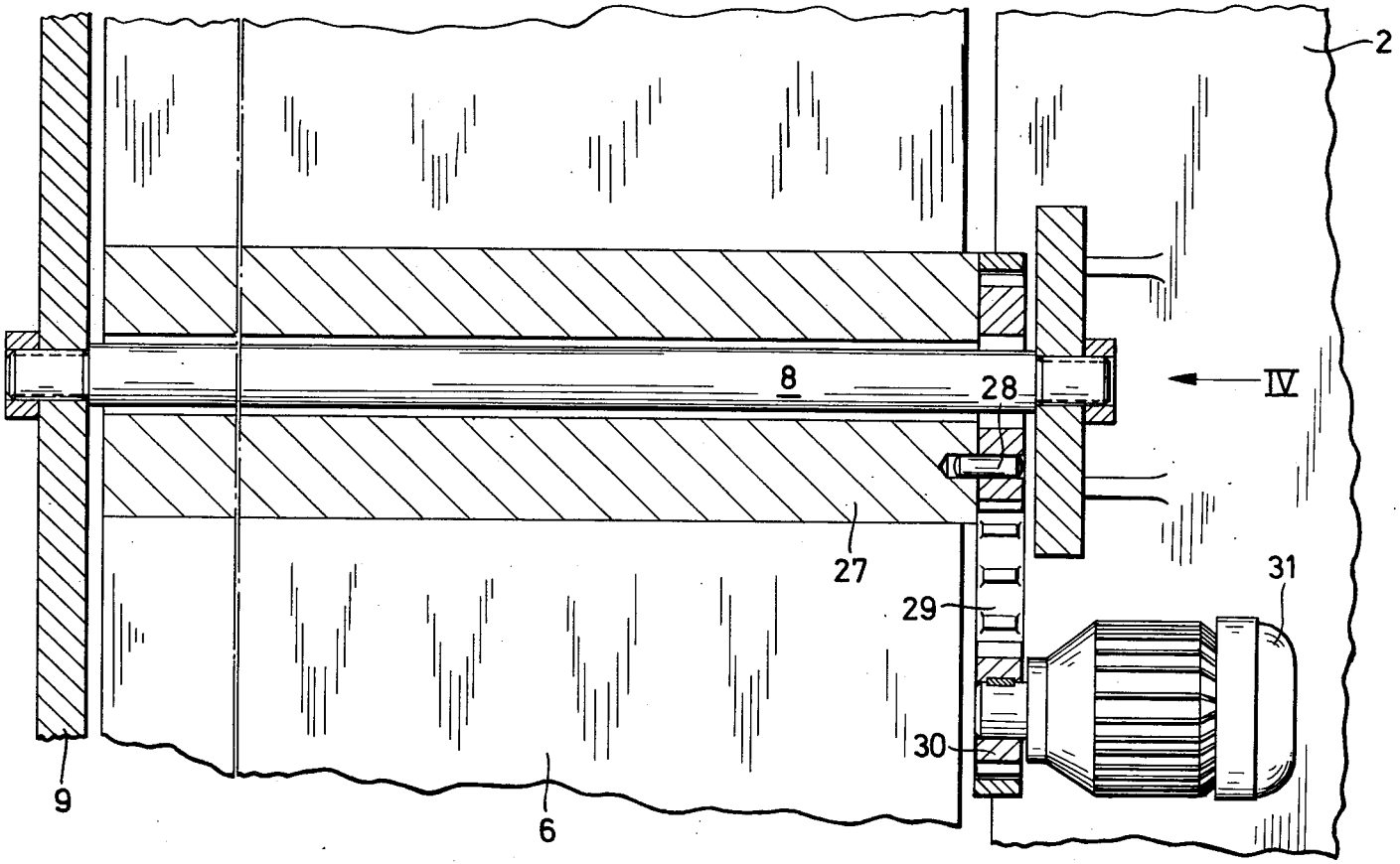
FIG. 3 is a cross sectional view taken along the line III—III in FIG. 1.
Figure 4:
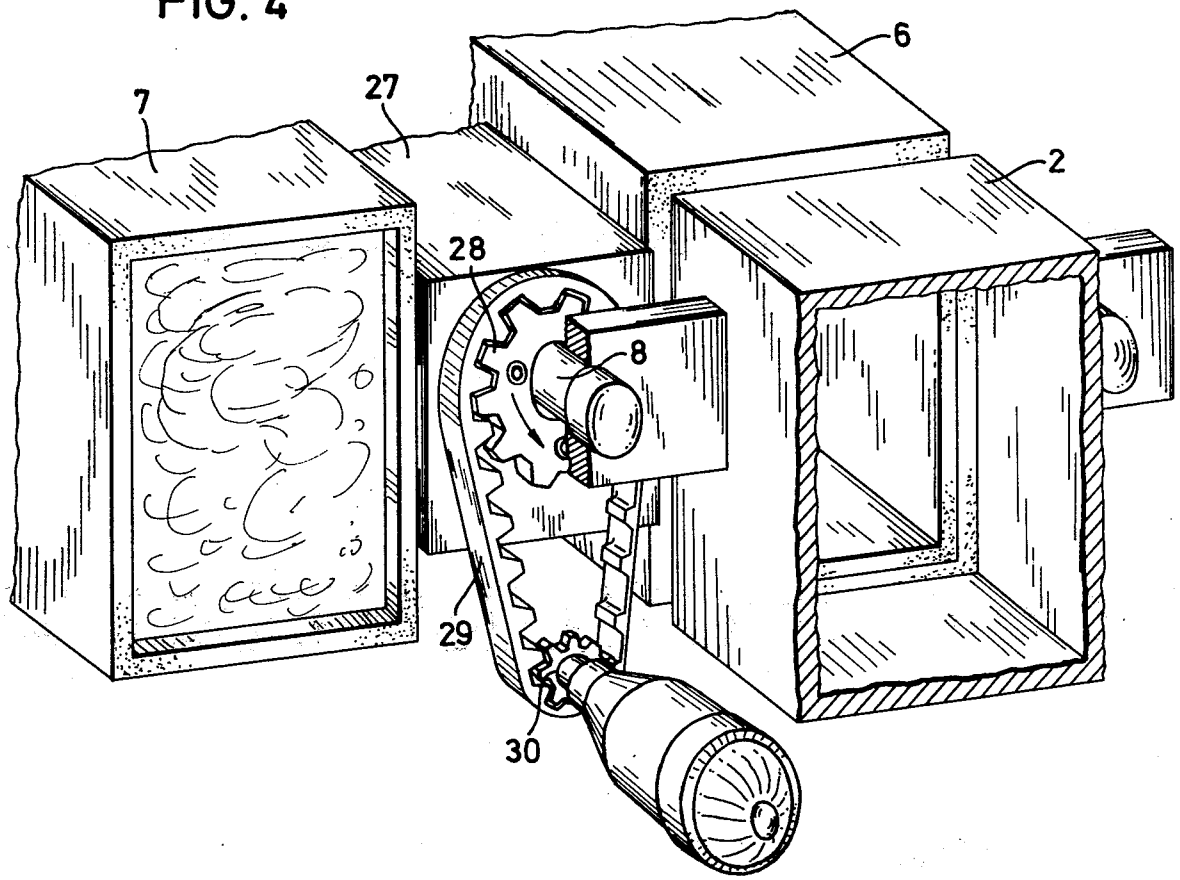
FIG. 4 is an end view of a portion of the apparatus in FIG. 1 taken in the direction of the arrow IV in FIG. 3.

In the preferred example illustrated, the refuse press 1 is in the form of a horizontal revolving box press, comprising two pressing boxes 6 and 7, which are pivoted about a rod 8 parallel to the direction of movement of the plunger 4, so that each pressing box in turn can be brought into a pressing position and into an ejection position. The rod 8 also constitutes a connecting bar between the filler box 2 and a counter-abutment device 9 which accepts the pressing pressure and which is connected by at least one further rod 11, situated symmetrically to the rod 8, on the other side of the filler box 2. As shown in FIGS. 1 and 2, the rod 8 extends through a hollow column 27, there is some play between the rod and the column. The column rigidly connects the pressing boxes together. A drive wheel 28 is mounted on the column 27. A gear belt 29 connects the drive wheel 28 to a pinion 30 mounted on the shaft of a drive motor 31. As shown in FIG. 1, when the pressing box 6 is filled and the other pressing box 7 is empty and the plunger is in its withdrawn position, the drive motor 31 is started for reversing the positions of the pressing boxes, note FIG. 4 which also shows the structure for pivoting the pressing boxes. A recess 26 in the apparatus foundation, note FIG. 2, facilitates the rotation of the pressing boxes. In the position illustrated, the pressing box 6 is in the pressing position and the pressing box 7 which is already filled with pressed refuse, is in the ejection position. In this position, the pressing box 7 is in alignment between an ejector plunger 12 and a container 13, which is to be filled and which is coupled for the purpose of the filling operation in a known manner to the pressing box 7. Further containers 13*a* to be filled, are ready and available to the left of container 13, while an already filled container 13*b* is shown in the drawing to the right alongside the container 13 which is coupled to the pressing box 7.

Ahead of and associated with the refuse press, there is a device for selecting and preparing refuse for filling one container from a number of refuse truck loads. This device comprises firstly a weighing apparatus 14, on which each loaded refuse truck 15 is weighed on arrival, and which issues a weight card giving the net weight of the contents of the refuse truck. The weighed refuse truck 15 then travels to one of several tilting troughs 16, which are arranged alongside one another, any trough which is empty being used, and the truck discharges its load into the trough. At the same time, the weight card is fed into a weight indicator 17, associated with the relevant tilting trough 16. The indicator 17 signals the weight of the batch of refuse together with an identifying number of the associated tilting trough to a central computer 18. The computer 18 carries out compared additions with the existing weights of the contents of the other tilting troughs and selects those batches the sum of weights of which is an optimum approximation to the predetermined permissible weight of the contents of the container. One of the selected tilting troughs 16 is then emptied by tilting it about an axis 24 located below the trough on to one of two conveyor belts 19 and 21, which are disposed symmetrically one on each side of the refuse press. The trough is tilted by a hydraulic cylinder 25. In FIG. 2 the trough 16 is shown in full lines in position to receive refuse from the truck 15 and in dot-dash lines emptying the refuse onto the conveyor belts. The belts extend along the row of tilting troughs and convey in a direction perpendicular to the pressing direction as indicated by arrows A and B. The conveyor 19 is driven by a drive motor 22 and the conveyor 21 is driven by a drive motor 23. This arrangement of the troughs and belts relative to the refuse press 1 ensures not only optimum space utilisation but also minimum conveying distances between the individual tilting troughs 16 and the filler shaft 3.

The tilting trough 16 which has just been emptied is again filled by a succeeding refuse truck 15 and is then ready for renewed checking for the selection of an optimum residual filling for the container. It can always happen that the most recently filled tilting trough is exchanged for one which already forms part of the selection, provided that, as a result, a closer approximation to the desired predetermined container contents weight is obtained than that obtained by the previously selection effected by the computer. The checking of the batch selection is repeated after each filling of a tilting trough, until the last tilting trough has been tipped on to one of the conveyor belts 19 or 21 to provide the full number of batches for filling the container. It is therefore of advantage, for the selection of the batches from the tilting trough fillings, which will differ in weight according to their composition, to provide the contents of one container, if the number of tilting troughs 16 kept filled is as large as possible, so that as many tilting trough fillings as possible are available for the selection.

Although the preferred method of operating has been described above with continually repeated checking and where necessary modified selection of tilting troughs during the pressing of the contents for one container, it is alternatively possible to operate by a method in which all the selected tilting troughs are simultaneously emptied on to the conveyor belt or belts. However in this way, under some circumstances a less ideal container filling is attained than with the method described above. On the other hand, the filling operation of the container itself is concluded more rapidly.

I claim:

1. Apparatus for use in the filling of a container with refuse which has been compacted by pressing, said apparatus comprising a weighing device for weighing refuse collecting vehicles, a plurality of refuse holders, each of said holders being capable of holding a batch of refuse from one of said refuse collecting vehicles, means for discharging said batches of refuse from said holders, a refuse press, said press comprising a filler box, a pressing plunger, means for moving said pressing plunger along a horizontal path through said filler box, a filling shaft leading into said filler box in a direction transverse to the direction of movement of said pressing plunger and a pressing box aligned with said filler box, said pressing box including a plurality of walls, said plunger being operative to push refuse, which is introduced through said filling shaft into said filler box, into said pressing box and compress said refuse against one of said walls, and at least one conveyor for conveying batches of refuse discharged from said holders to said filling shaft of said press.

2. Apparatus as claimed in claim 1, wherein each of said holders includes a trough and means for tilting said trough to discharge the contents thereof on to said conveyor, there being a number of troughs such that the sum of their capacities is greater than the capacity of said container.

3. Apparatus as claimed in claim 2, wherein said number of tilting troughs is at least twice the number necessary to fill said container.

4. Apparatus as claimed in claim 1, further comprising a weight indicator associated with each of said holders, a computer and means operatively connecting each of said weight indicators to said computer, said computer being operative to select from said holders a plurality of batches of refuse, the sum of the weights of which approximates to a predetermined weight of the contents of said container, and means operatively connecting said computer to said discharging means to cause said holders to discharge said plurality of selected batches on to said conveyor.

5. Apparatus as claimed in claim 1, wherein said press includes two pressing boxes, means pivotally mounting said pressing boxes for rotary movement about a horizontal axis parallel to said direction of movement of said pressing plunger, a counter-abutment, an ejector plunger spaced from said counter-abutment, means defining a station for a container to be filled in alignment with said ejector plunger, and means for rotating said pressing boxes between a pressing position in alignment with said pressing plunger between said filler box and said counter-abutment and an ejecting position in alignment between said ejector plunger and said station.

6. Apparatus as claimed in claim 1, further comprising means mounting said holders in a row, and wherein said conveyor includes two conveyor belts, means mounting said conveyor belts extending along said row, with said belts disposed one on each of two opposite sides of said filling shaft and means for moving said conveyor belts towards said filling shaft in a direction perpendicular to said direction of movement of said pressing plunger.

* * * * *